United States Patent [19]

Romer

[11] Patent Number: 4,660,333

[45] Date of Patent: Apr. 28, 1987

[54] GUTTER SYSTEM

[75] Inventor: Theodore Romer, New York, N.Y.

[73] Assignee: Aljo Products, Inc., Vauxhall, N.J.

[21] Appl. No.: 751,801

[22] Filed: Jul. 3, 1985

[51] Int. Cl.[4] ..... E04C 2/52

[52] U.S. Cl. ..... 52/169.5; 52/169.9; 52/98; 52/366; 52/716

[58] Field of Search ..... 52/169.5, 169.9, 169.14, 52/716, 717, 366, 391, 98, 100, 274

[56] References Cited

U.S. PATENT DOCUMENTS

| | | | |
|---|---|---|---|
| 1,270,405 | 6/1918 | Gibson | 52/366 |
| 1,803,723 | 5/1931 | Murphy | 52/370 |
| 2,581,521 | 1/1952 | Davis | 52/169.5 |
| 2,793,403 | 5/1957 | Livingston | 52/366 |
| 3,464,177 | 9/1969 | Amato | 52/717.1 |
| 3,473,278 | 10/1969 | Gossen | 52/717.1 |
| 3,707,817 | 1/1973 | Schmitt et al. | 52/274 |
| 3,873,402 | 3/1975 | Mrasek | 52/100 |
| 4,091,586 | 5/1978 | Schwartz | 52/716 |
| 4,143,496 | 3/1979 | Destito | 52/391 |
| 4,185,429 | 1/1980 | Mendola | 52/169.5 |
| 4,267,677 | 5/1981 | Randolph et al. | 52/716 |
| 4,391,071 | 7/1983 | Schantz | 52/169.5 |

OTHER PUBLICATIONS

Beaver Basement Water Control System Installation Guide.

*Primary Examiner*—William F. Pate, III
*Assistant Examiner*—Caroline D. Dennison
*Attorney, Agent, or Firm*—Lerner, David, Littenberg, Krumholz & Mentlik

[57] ABSTRACT

A gutter system is disclosed for waterproofing basements and the like by channeling seepage water around the perimeter of the basement to either drain or open pit which may contain a sump pump. The gutter system is provided in kit form which includes a plurality of individual components which can be connected together by connecting members into a variety of configurations. Each component of the system is adhesively bonded to the floor and provided with an open conduit arranged facing the wall for channeling water which is collected therein.

36 Claims, 10 Drawing Figures

GUTTER SYSTEM

BACKGROUND OF THE INVENTION

The present invention relates in general to a gutter system, and more particularly, to such a gutter system adapted for channeling a fluid around a portion of a boundary of a confined area defined by the perimeter of a floor and an adjoining wall, such as in a basement where ground water seepage through hydrostatic pressure is present, thereby waterproofing the confined area.

Homes and small buildings often have their basements constructed from poured concrete walls or cement block walls. In either case, cracks frequently develop which extend from the upper part of the wall down to the adjoining floor. These cracks seep water in order to relieve the hydrostatic pressure created around the basement walls. As a result, various techniques and devices have been employed to waterproof basements under these conditions.

One such system uses hollow baseboard sections extending around the perimeter of the floor adjacent the wall. The baseboard sections are adhesively bonded to the floor and provided with a plurality of openings facing the wall for receiving water seeping into the basement. The water, once collected in the baseboard sections, can be channeled to a floor drain or sump pump for removal. This system requires that the baseboard sections be individually cut into their required lengths, which are joined together by specially designed butt-joint connectors. These connectors, although forming a water-tight joint, do not possess the mechanical strength necessary to withstand any moderate force which may be accidently applied when utilizing the baseboard sections. In addition, the necessity of having to cut the baseboard sections into varied lengths, if not performed accurately, can result in the inability to utilize these baseboard sections in installing the gutter system. Further, the holes provided in the baseboard sections to collect water, can become clogged with debris and the like, thereby precluding the efficient collection of water by the gutter system.

SUMMARY OF THE INVENTION

It is broadly an object of the present invention to provide a gutter system which overcomes or avoids one or more of the foregoing disadvantages resulting from the use of the above-mentioned gutter system, and which fulfills the specific requirements of such a gutter system for use in waterproofing a basement by channeling seepage water around a portion of the boundary of the basement to a floor drain or sump pump for ultimate removal.

Specifically, it is within the contemplation of one aspect of the present invention to provide a gutter system which can be sold as a kit, including inside and outside corner members, end cap members, connecting members, straight gutter members and straight gutter members which are dividable into portions of predetermined lengths.

Another object of the present invention is to provide a gutter system which is inexpensive to construct and requires simple techniques for installation.

Another object of the present invention is to provide gutter system which facilitates its installation around obstructions such as pipes and which provides simple and effective communication with floor drains and sump pumps.

Another object of the present invention is to provide a gutter system which facilitates the watertight joining of various components of the system and which joints possess substantial mechanical strength.

Another object of the present invention is to provide a gutter system which insures the collecting of seepage water around the basement walls without the need for maintaining openings free from debris and the like.

In accordance with one embodiment of the present invention, there is described a gutter for channeling a fluid around a portion of the boundary of a confined area defined by the perimeter of a floor and an adjoining wall. The gutter is constructed of at least one first longitudinally extending member having a base and a side upwardly extending from the base at an acute angle thereby defining an open conduit, the member being arranged adjacent the wall along a portion of the perimeter of the floor and secured to the floor along its base, the open conduit facing the wall for channeling a fluid collected therein.

In accordance with the disclosed embodiment, the base is provided with a plurality of spaced-apart holes, preferably of irregular shape, such that adhesive can extend through the holes to enhance the securing of the member to the floor.

In accordance with the disclosed embodiment, there is further provided at least one second longitudinally extending member having a base and a side upwardly extending from the base at an acute angle thereby defining an open conduit. A plurality of traverse score lines longitudinally divide the side and a plurality of transverse slots longitudinally divide the base, the slots being in registration with the score lines whereby predetermined portions of the second member can be separated from the remainder of the second member.

In accordance with the disclosed embodiment, there is further provided at least one connecting member receivable within the open conduits of the first and second members for connecting the first member in longitudinal alignment with a portion of the second member, the connecting member including a base and a side upwardly extending from the base at an acute angle.

In accordance with the disclosed embodiment, locking means, in the nature of projections and depressions, are provided on the first and second members and the connecting member for locking the first and second members to the connecting member.

In accordance with the disclosed embodiment, a stop is provided adjacent the projections on the first and second members for engaging the ends of the connecting member when the connecting member is received within the open conduits of the first and second members.

In accordance with the disclosed embodiment, there is provided at least one inside corner member and at least one outside corner member for joining the first and/or second members together at substantially a right angle to one another with their open conduits being in fluid communication with each other.

In accordance with the disclosed embodiment, there is further provided at least one right end cap and at least one left end cap securable to either end of the first or second members to close their open conduits thereat.

BRIEF DESCRIPTION OF THE DRAWINGS

The above description, as well as further objects, features and advantages of the present invention, will be more fully understood by reference to the following detailed description of the presently preferred, but nontheless illustrative, gutter system in accordance with the present invention, when taken in conjunction with the accompanying drawings, wherein.

DETAILED DESCRIPTION

Figure 1:
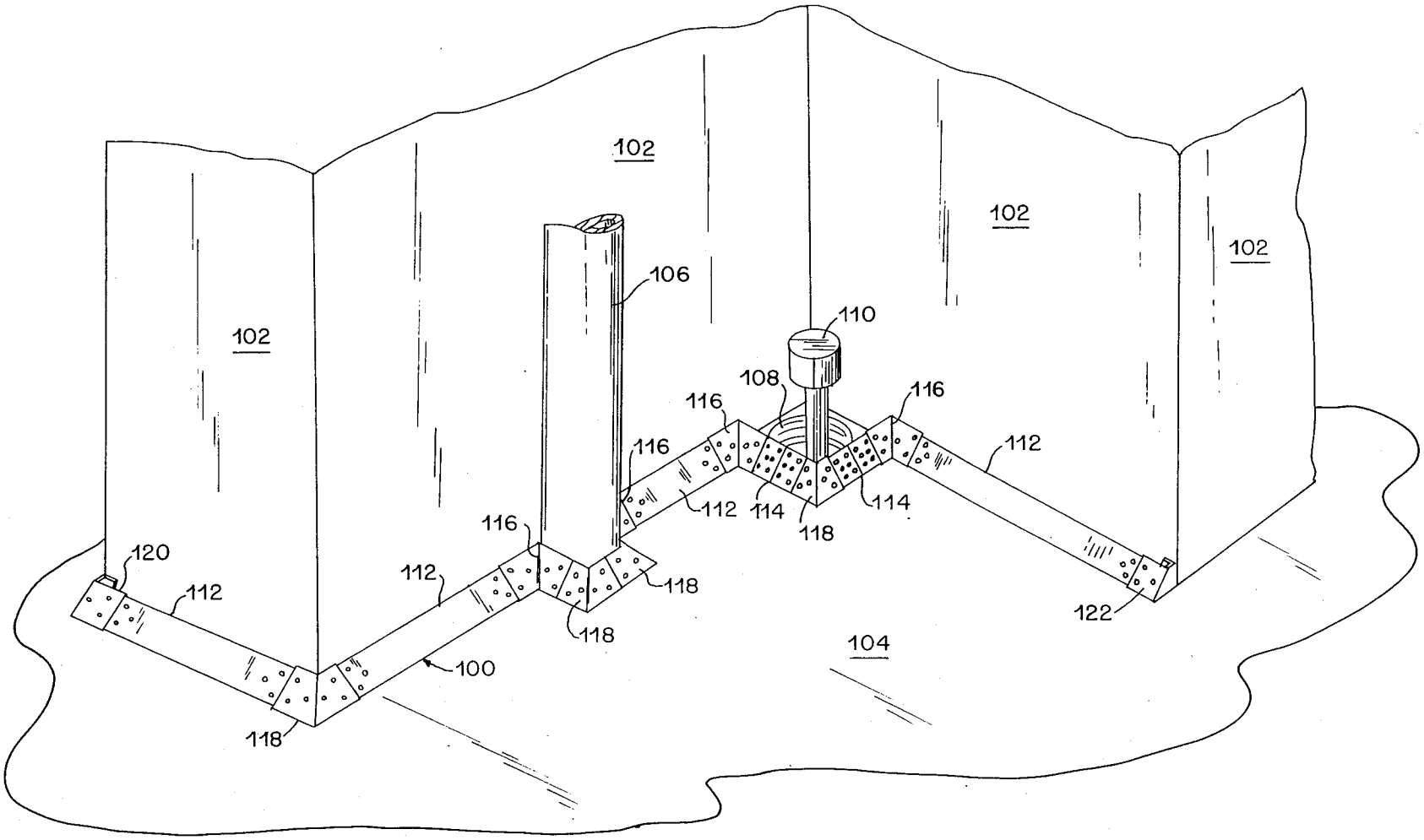
FIG. 1 is a perspective view of the gutter system showing its arrangement within a basement for channeling seepage water to a sump pump around a portion of the boundary of the confined area having at least one pipe obstruction.

Referring now to FIG. 1 wherein like reference numerals represent like elements, there is disclosed a gutter system generally designated by reference numeral 100. The gutter system 100 is particularly adapted for use in basements of homes and small buildings having poured concrete or block-type walls. As shown, the basement includes one or more upstanding walls 102 bordering the boundary of a confined area about the perimeter of a floor 104. The basement is further provided with an obstruction 106, such as a pipe, and a corner positioned floor drain or open pit 108 provided with a sump pump 110. The gutter system 100 is secured to the floor 104 about its perimeter adjacent the walls 102. In this regard, the gutter system 100 is constructed to extend around the pipe 106 and around the floor drain or open pit 108 to provide a continuous channel for channeling seepage water to the sump pump 110 which is collected within the gutter system.

Figure 8:
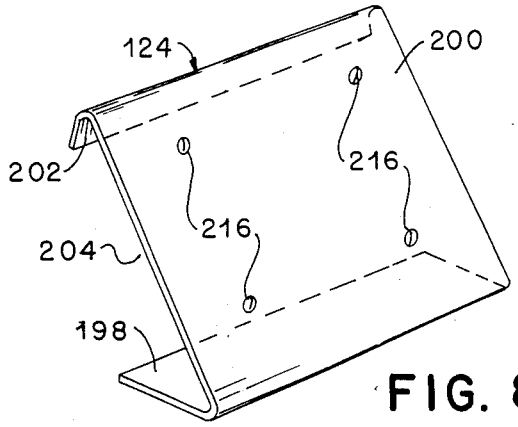
FIG. 8 is a perspective view of a connecting member.
Figure 9:
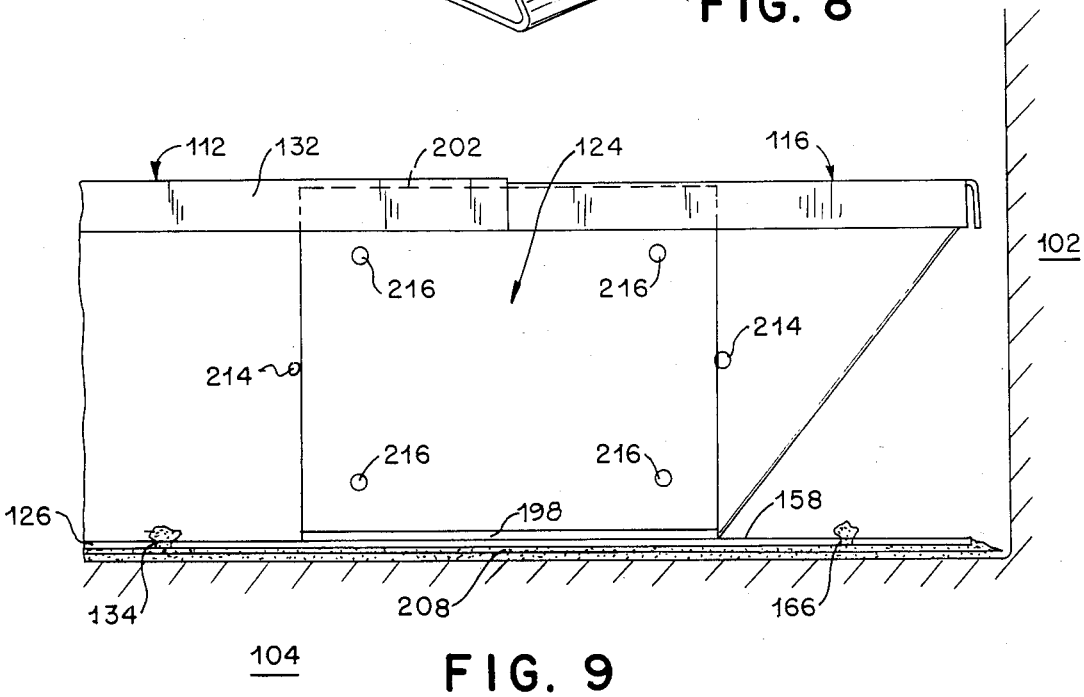
FIG. 9 is a rear elevational view showing a partial section of the gutter system including a gutter member joined by a connecting member to an inside corner member, which gutter system is shown arranged adjacent a wall and secured by adhesive to the underlying floor.
Figure 10:
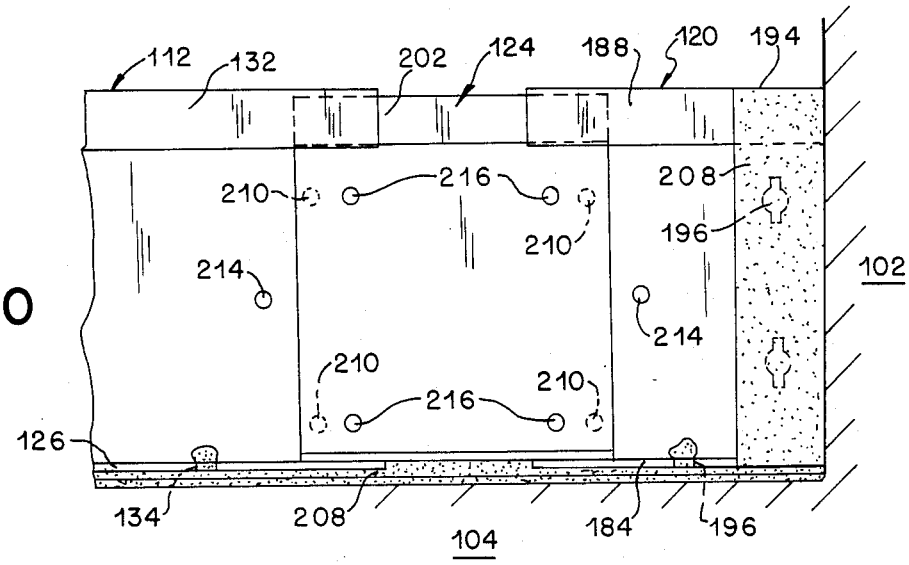
FIG. 10 is a rear elevational view showing a portion of a gutter system including an end cap member joined in spaced-apart relationship to a gutter member, which gutter system is shown arranged adjacent a wall and secured to an underlying floor by an adhesive layer.

The gutter system 100 is constructed from a number of components which are assembled in the manner to be described. More particularly, the gutter system includes longitudinally extending gutter members 112, longitudinally extending scored gutter members 114, inside corner members 116, outside corner members 118, a left end cap member 120, a right end cap member 122 and a plurality of connecting members 124 which are shown in FIGS. 8–10. By use of the connecting members 124, the remaining aforementioned members 112, 114, 116, 118, 120, 122 can be arranged as shown in FIG. 1 or in any configuration desired to provide a gutter system 100 in accordance with the present invention. As such, the gutter system 100 can accommodate walls 102 of different lengths, obstructions 106 of different size and locations, as well as facilitating the use of floor drains or open pits 108 which may optionally include a sump pump 110. It should be understood that the specific arrangement of the gutter system 100, as shown in FIG. 1, is merely exemplary of one such system. Therefore, it is to be understood that other variations and arrangements may be devised by employing the components of the present invention.

Figure 2:
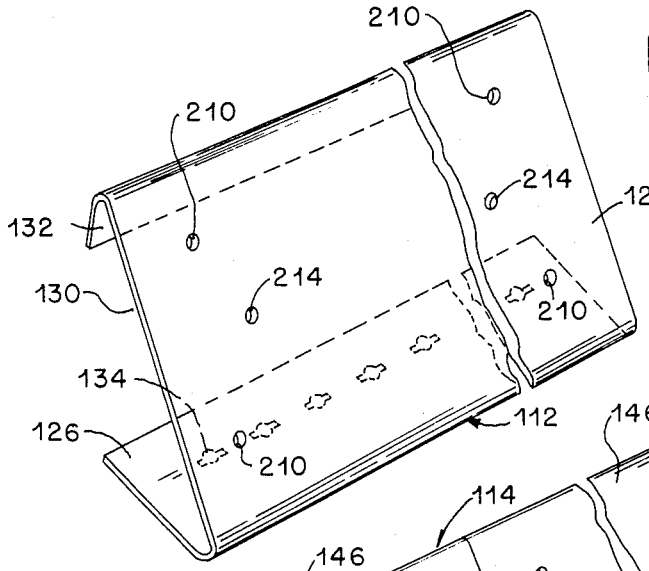
FIG. 2 is a perspective view of a gutter member constructed to define an open conduit.

Turning now to FIG. 2, the gutter member 112 is shown in greater detail. Specifically, the gutter member 112 is constructed from a base 126, a side 128 upwardly extending from the base at an acute angle to define an open conduit 130, and a lip 132 downwardly extending along one edge of the side and opposing the base. The base 126 is provided with a plurality of spaced-apart holes 134, preferably of irregular shape, such as stars, clovers or the like. In accordance with the preferred embodiment, the side 128 defines a 45° angle with the base 126, however, other acute angles may be employed with equal utility. In addition, the lip 132 is optional and may extend downward at any preselected angle, as well as extending outwardly in a horizontal orientation.

Figure 3:
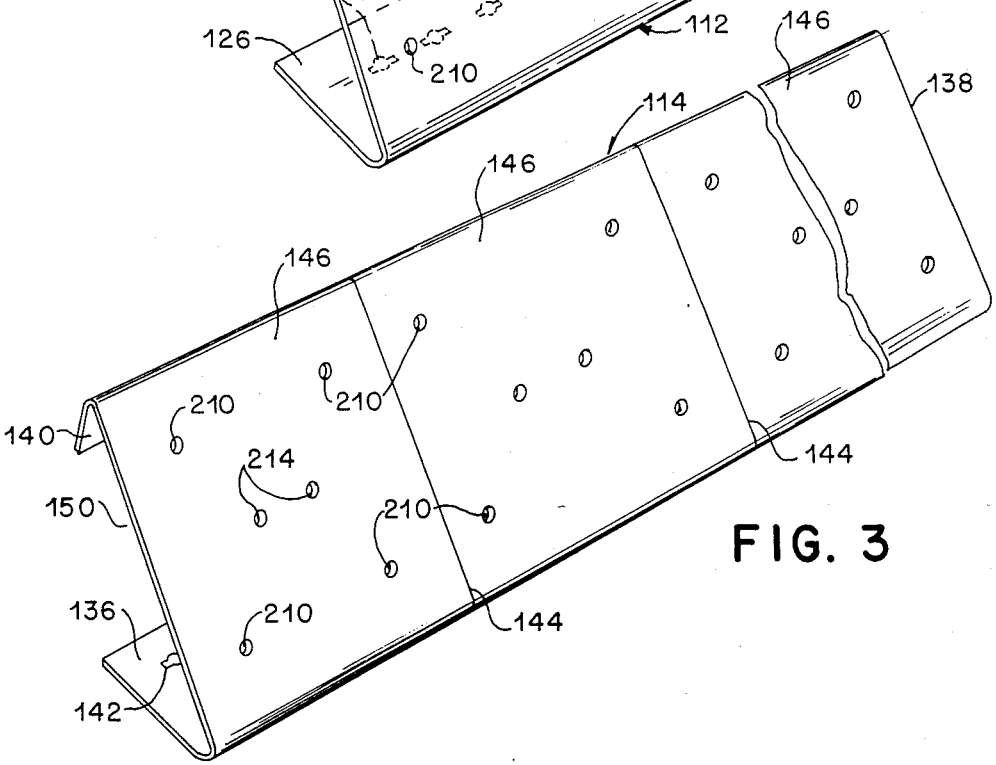
FIG. 3 is a perspective view of a gutter member constructed to define an open conduit and having a plurality of transverse score lines adapted for separating the member into predetermined lengths.
Figure 4:
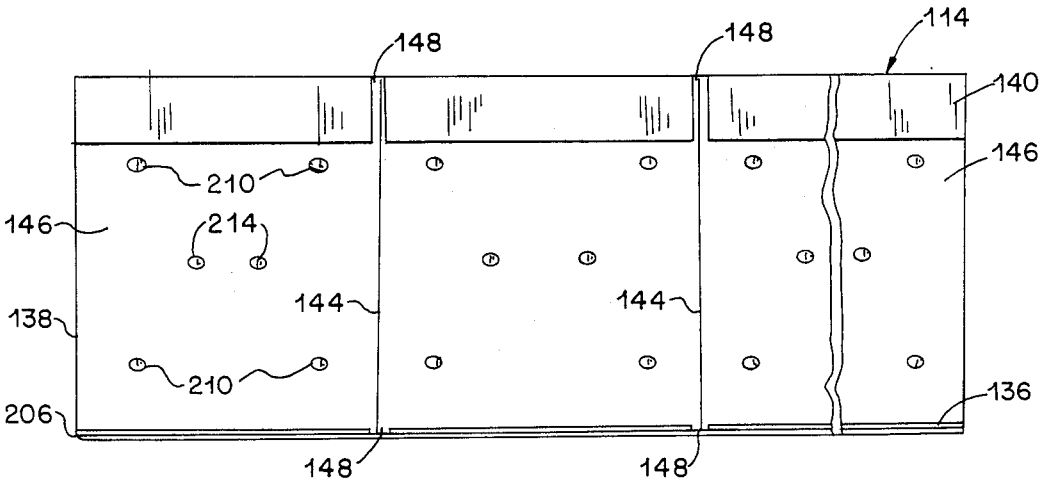
FIG. 4 is a rear elevational view of the gutter member shown in FIG. 3, such member having slots arranged in alignment with the score lines to facilitate the separation of the member into predetermined lengths.

Referring now to FIGS. 3 and 4, the construction of the scored gutter member 114 is shown in greater detail. Specifically, the scored gutter member 114 is constructed substantially similar to the gutter member 112 in that it includes a base 136, a side 138, a lip 140 and a plurality of holes 142. In addition, the side 138 is provided with a plurality of spaced-apart transverse score lines 144, which divide the side into a plurality of predetermined portions 146, each generally being the same length, for example, three inches. A plurality of slots 148 are cut into the base 136 and lip 140 in registration with the score lines 144. In this regard, the slots 148 facilitate the separation of the detachable portions 146 along the score lines 144. Each detachable portion 146, in the manner as described with regard to the gutter member 112, defines an open conduit 150.

Figure 5:
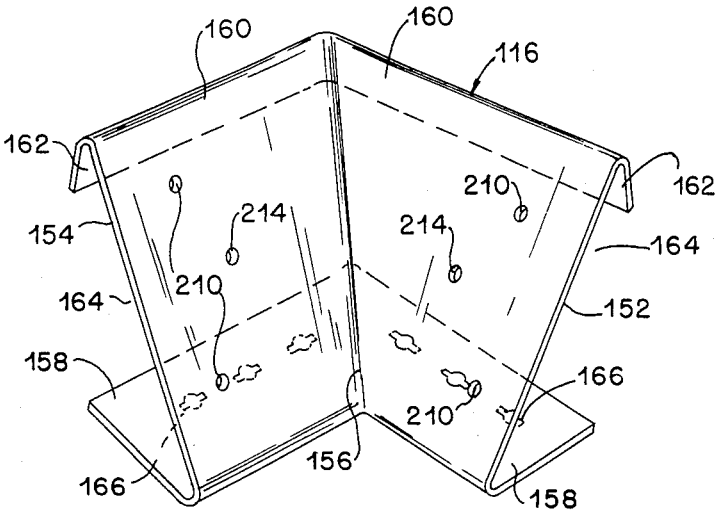
FIG. 5 is a perspective view of an inside corner member having side members arranged at substantially right angles to one another.
Figure 6:
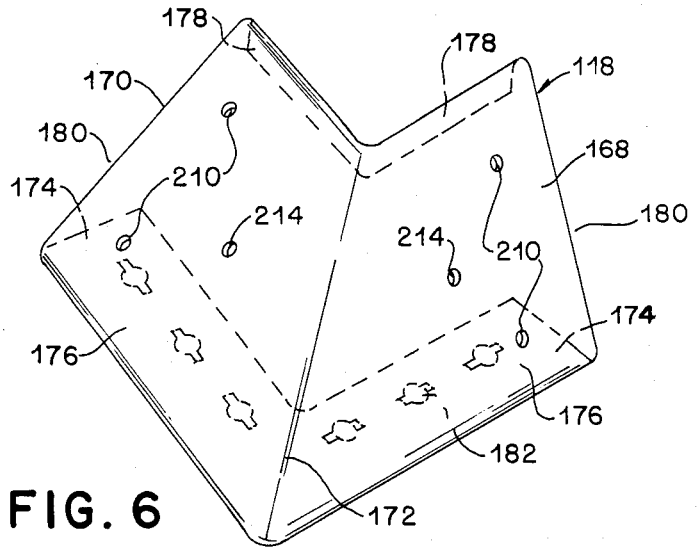
FIG. 6 is a perspective view of an outside corner member having side members arranged at substantially right angles to one another.
Figure 7:
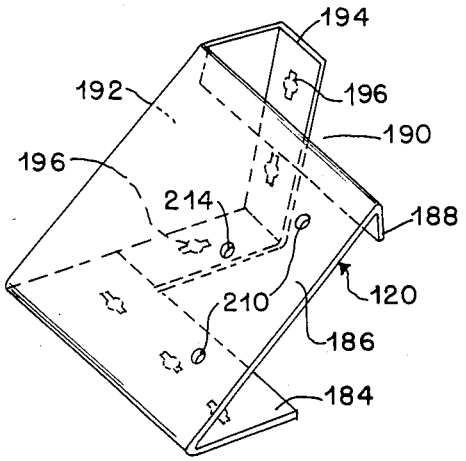
FIG. 7 is a perspective view of a left end cap member defining an open conduit having a closed end.

Turning now to FIGS. 5–7, a detailed description of the inside corner member 116, outside corner member 118, and left and right end cap members 120, 122 will now be described. Specifically referring to FIG. 5, the inside corner member 116 is constructed from a pair of side members 152, 154 joined together along joint 156 at substantially right angles to one another. Each side member 152, 154 includes a base 158, a side 160 and a lip 162, which are arranged to define an open conduit 164 in the manner as described with reference to the gutter member 112. The base 158 is also provided with a plurality of holes 166.

Turning now to FIG. 6, the outside corner member 118 is constructed from a pair of side members 168, 170 connected along a joint 172 at substantially right angles to one another. Each side member 168, 170 is constructed in a similar manner as the side members 152, 154 of the inside corner member 116. Specifically, the side members 168, 170 include a base 174, a side 176 and a lip 178 which define an open conduit 180. The base 174 is further provided with a plurality of spaced-apart holes 182. As should now be apparent from the foregoing description, the inside corner member 116 and outside corner member 118 are of substantially identical construction, except for the fact of their being adapted for use in going around either an inside corner or an outside corner of a wall 102 as shown in FIG. 1. Further in this regard, each of the side members 152, 154, 168, 170 are constructed in a substantially similar manner as the gutter member 112.

Turning now to FIG. 7, a detailed description of the left end cap member 120 will now be described. The left end cap member 120 is constructed from a base 184, a side 186 and a lip 188 which are arranged in a substantially similar manner as the gutter member 112 to define an open conduit 190. A vertical upstanding wall 192 is secured adjacent the left edge of the side 186 and base 184 to close the open conduit 190 thereat. a support wall 194 is attached to the rear edge of the end wall 192 in opposing relationship to the side 186 to provide a space of, for example, a one-eighth of an inch, from the lip 188. The base 184 and support wall 194 are each provided with a plurality of spaced-apart holes 196. Although only the left end cap member 120 has been described with reference to FIG. 7, it can be appreciated that the right end cap member 122 will be of the reverse construction from that described.

The final component, the connecting member 124, will now be described with reference to FIG. 8. As shown, the connecting member 124 includes a base 198, a side 200 and a lip 202 which are arranged in a similar manner to the gutter member 112 to define an open conduit 204. As to be described, the connecting member 124 is adapted for connecting a plurality of gutter members 112, scored gutter members 114, inside corner members 116, outside corner members 118, left end cap members 120 and right end cap members 122 together in a manner to provide the gutter system 100 of the present invention which, in accordance with one embodiment, is disclosed in FIG. 1.

The use of the connecting member 124 in this manner, to produce the gutter system 100 of the present invention, will now be described with reference to FIGS. 9 and 10. As shown in FIG. 9, the gutter system 100 includes a gutter member 112, inside corner member 116 and a connecting member 124. The gutter system 100, being arranged adjacent a pair of adjoining walls 102, has necessitated the use of the inside corner member 116.

Initially, the gutter member 112, scored gutter member 114, inside corner member 116, outside corner member 118, left end cap member 120 and right end cap member 122 are provided with an adhesive tape 206, as shown in FIG. 4, overlying the bottom surface of their respective bases 126, 136, 158, 174, 184, and support wall 194 to prevent dirt accumulation thereon, as well as to prevent obstruction of their respective holes 134, 142, 166, 182 and 196. The adhesive tape 206 is first removed and a thick layer 208 of adhesive is provided overlying the base 126 of the gutter member 112 and base 158 of the inside corner member 116. The adhesive used may be any suitable adhesive which is water-resistant such as, by way of example, only, an epoxy or the like. Prior to adhesively bonding the gutter member 112 and inside corner member 116 to the floor 104, the adhesive can be applied over the outer surface of the connecting member 124 which is then inserted into the respective open conduits 130, 164 of the gutter member and inside corner member. As shown, the gutter member 112 and inside corner member 116 are brought together to form a butt-type joint with the base 198 of the connecting member 124 arranged overlying the base 126 of the gutter member and the base 158 of the inside corner member, while the lip 202 of the connecting member underlies the lip 132 of the gutter member and the lip 162 of the inside corner member.

The gutter system 100 is arranged such that the lips 132 of the gutter member 112 and the lip 162 of the inside corner member 116 are spaced approximately one-eighth of an inch from the walls 102 by using a one-eighth inch spacer (not shown). The spacer may conveniently be a portion of the container, for example, cardboard box, in which the gutter system 100 is supplied. As the gutter member 112 and the inside corner member 116 are forced downward against the floor 104, the adhesive spreads out and upward through the irregular-shaped holes 134, 166. Upon setting of the adhesive layer 208, the adhesive within the holes 134, 166 provides a perpendicular post which enhances the bond of the gutter system 100 to the underlying floor 104.

Turning now to FIG. 10, a portion of the gutter system 100 comprising a gutter member 112 and left end cap member 120 is disclosed. The assembly of the left end cap member 120 to the gutter member 112 using the connecting member 124 is substantially similar to that as previously described in FIG. 9 with regard to the gutter member and inside corner member 116. In this regard, it is noted that an adhesive layer 208 is additionally applied over the rear surface of the support wall 194 to provide a water-proof bond between the support wall and the adjacent wall 102. As shown, the connecting member 124 is suitable for providing a spaced-apart joint, as opposed to a butt-type joint shown in FIG. 9. For example, where the gutter member 112 is not of sufficient length to mate with the end of the left end cap member 120, the gap may be taken up by the central portion of the connecting member 124. To this end, the adhesive layer 108, provided between the floor 104 and the base 126 of the gutter member 112 and base 184 of the left end cap member 120, will accommodate the gap to provide a water-tight seal therebetween.

Based upon the space arrangements of the basement, it may be necessary to use sections of the gutter member 112 which are shorter than that provided for by the gutter member. To avoid the necessity of having to cut the gutter member 112 into shorter lengths as needed, one may use the scored gutter member 114. For example, if a twelve inch gutter section is required, one may separate four detachable portions 146 from the scored gutter member 114 along one of the score lines 144, that is, where each detachable portion is three inches long. The detached portions 146 may now be used in completing the gutter system 100 in the identical manner as the gutter member 112. In accordance with the embodiment described, the scored gutter member 112 may provide detachable portions 146 in any multiple of three inches. However, other multiples may be provided for by either narrowing or increasng the spacing between the score lines 144. It should now be appreciated that the use of the miscellaneous components of the gutter system 100, as thus far described, results in a very versatile and simple gutter system to be installed in a variety of configurations as desired or as mandated by the layout of the basement into which the system is being incorporated.

As a further feature of the present invention, the above-mentioned components of the gutter system 100 are provided with locking means which allow for the releasable interlocking of the various components when installing the gutter system, for example, as illustrated in FIG. 1 and as described herein. As shown in FIGS. 2–7, the gutter member 112, scored gutter member 114, inside corner member 116, outside corner member 118, left end cap member 120 and right end cap member 122 are each provided with a plurality of spaced-apart male projections 210. The projections 210 are arranged in pairs, one above the other, adjacent the free ends of the gutter member 112, inside and outside corner members 116, 118 and left and right end cap members 120, 122. In the case of the scored gutter member 114, the projections 210 are additionally arranged adjacent either side of the score lines 144, as shown in FIGS. 3 and 4. Positioned adjacent the projections 210 and inwardly thereof, is male projecting stop 214. Finally, as shown in FIG. 8, the connecting member 124 is provided with pairs of female depressions 216 arranged one above the other at opposite ends of the connecting member. In this regard, it is to be noted that the spaced-apart relationship between the depressions 216 correspond to the spaced-apart relationship between the projections 210.

As shown in FIG. 9, when the connecting member 124 is received by, for example, the gutter member 112 and inside corner member 116, the male projections 210 are received within the female depressions 216, which secures the connecting member to the gutter member and inside corner member. However, as the projections 210 are releasably received within the depressions 216, the gutter member 112 may be separated from the inside corner member 116 prior to their being adhesively bonded to the floor 104, as may be required for adjustment or other such purpose. As is further shown in FIG. 9, the stops 214 prevent the connecting member 124 from being engaged either by the gutter member 112 or inside corner member 116 to a greater extent than required for the engagement of the projections 210 with the depressions 216. In this manner, the stops 214 butt against the outside edges of the connecting member 124, thereby preventing any further engagement with the gutter member 112 or inside corner member 116.

Although the invention herein has been described with reference to particular embodiments, it is to be understood that these embodiments are merely illustrative of the principles and application of the present invention. It is therefore to be understood that numerous modifications may be made in the illustrative embodiments and that other arrangements may be devised without departing from the spirit and scope of the present invention as defined by the appended claims.

What is claimed is:

1. A gutter system for collecting and channeling a fluid around a portion of the boundary of a confined area defined by that portion of the perimeter of a floor which is joined to an upstanding wall, said gutter system comprising at least one longitudinally extending first member having a base and a side upwardly extending from its base at an angle thereby defining an open conduit for collecting and channeling fluid therein, at least one longitudinally extending second member having a base and a side upwardly extending from its base at an angle thereby defining an open conduit, said second member having a plurality of transverse score lines longitudinally dividing its side and a plurality of transverse slots longitudinally dividing its base, said slots being in registration with said score lines, whereby predetermined lengths of said second member between said score lines can be separated from the remainder of said second member, at least one connecting member receivable within said open conduits of said first and second members for connecting said first member in longitudinal alignment with the separated portion of said second member, whereby said first and second members when connected together by said connecting member have a predetermined length, said first and second members arranged along a portion of the perimeter of said floor adjacent said upstanding wall and secured to said floor along their respective bases, the sides of said first and second members spaced from said upstanding wall to provide an entrance to said open conduit for collecting fluid therein from that portion of said upstanding wall above said entrance, said open conduit facing said upstanding wall for channeling fluid collected therein around the perimeter of said floor adjacent said upstanding wall, whereby collected fluid is prevented from flowing away from the perimeter of said floor.

2. The gutter of claim 1, wherein said side extends from said base at substantially a 45-degree angle.

3. The gutter of claim 1, wherein said base includes a plurality of spaced apart holes.

4. The gutter of claim 3, wherein said holes are irregularly shaped.

5. The gutter of claim 3 further including an adhesive layer provided between said base and said floor for securing said member thereto, said adhesive extending through said holes to enhance the securing of said member to said floor.

6. The gutter of claim 1, further including a lip downwardly extending along an edge of said side, said lip opposing said base and spaced from said wall.

7. The gutter of claim 1, further including a lip downwardly extending along an edge of said side of said second member, said lip having a plurality of transverse slots in registration with said score lines for longitudinally dividing said lip to facilitate separating said predetermined portions of said second member from the remainder thereof.

8. The gutter of claim 1, wherein said connecting member includes a base and a side upwardly extending from said base at an acute angle, said base of said connecting member arrangable overlying a portion of the base of said first and second members.

9. The gutter of claim 8, wherein said sides of said first member, said second member, and said connecting member, each include a downwardly extending lip along an edge thereof, said lip of said connecting member arrangable underlying a portion of said lip of said first and second members.

10. The gutter of claim 1, wherein said connecting member and those portions of said second member between said score lines each include locking means for locking said connecting member to said second member are when said connecting members received within said open conduit of said second member.

11. The gutter of claim 10, wherein a portion at the ends of said first member include said locking means for locking said connecting member to said first member when said connecting member is received within said open conduit of said first member, whereby said first and second members are connected together in longitudinal alignment with one another by said connecting member.

12. The gutter of claim 11, wherein said locking means comprise projections on said first and second members and depressions on said connecting member, said depressions releasably receiving said projections therein.

13. The gutter of claim 11, further including a stop adjacent said locking means of said first and second members for engaging the ends of said connecting member when said connecting member is received within said open conduits of said first and second members.

14. The gutter of claim 1, further including protection means releasable covering the bottom surface of said base for protecting said surface.

15. The gutter of claim 1, further including at least one corner member having first and second side members joined together to form a substantially right angle, said side members having an open conduit and adapted for securing a pair of said first members substantially perpendicular to one another with said open conduits in fluid communication with each other.

16. The gutter of claim 15 further including at least one connecting member receivable within said open conduits of said first member and said side members for connecting said first member to one of said side members.

17. The gutter of claim 16, wherein said side members include projections and said connecting member includes depressions for releasably receiving said projections when joining said connecting member to said corner member.

18. The gutter of claim 17, wherein said side members further include a stop adjacent said projections for engaging an end of said connecting member when said connecting member is received within said open conduit of said corner member.

19. The gutter of claim 15, wherein said side members each include a base and a side upwardly extending from said base at an acute angle to provide said open conduit, said base including a plurality of spaced apart holes for enhancing the securing of said corner member to said floor by an adhesive extending through said holes when said adhesive is provided between said base of said corner member and said floor.

20. The gutter of claim 19, wherein said side members further include a lip downwardly extending along an edge of said side of said corner member.

21. The gutter of claim 15, wherein said corner member comprises at least one inside corner member and at least one outside corner member.

22. The gutter of claim 1, further including at least one end cap securable to either end of said first member to close said open conduit thereat.

23. The gutter of claim 22, wherein said end cap includes a base, a side wall upwardly extending from said base at an acute angle and an end call extending upwardly from said base and joined to said side wall, said end cap providing an open conduit having a closed end at said wall.

24. The gutter of claim 23, further including at least one connecting member receivable within said open conduits of said end cap and said first member for securing said end cap and said first member in longitudinal registration with one another.

25. The gutter of claim 24, wherein said side of said end cap includes projections and said connecting member includes depressions for receiving said projections when joining said connecting member to said end cap.

26. The gutter of claim 25, wherein said side of said end cap further includes a stop adjacent said projections for engaging an end of said connecting member when said connecting member is received within said open conduit of said end cap.

27. The gutter of claim 22, wherein said end cap comprises at least one left end cap and at least one right end cap.

28. The gutter of claim 1, further including at least one inside corner member, at least one outside corner member, at least one end cap, at least one connecting member and at least one second member having means for separating said second member into portions of predetermined length.

29. The gutter of claim 1, wherein said side is arranged at an acute angle to said base.

30. A gutter for collecting and channeling a fluid around a portion of the boundary of a confined area defined by the perimeter of a floor and an adjoining wall, said gutter comprising at least first and second longitudinally extending members each having a base and a side upwardly extending from said base at an angle thereby defining an open conduit for collecting and channeling said fluid therein, said members joined together in end-to-end relationship and arranged along a portion of the perimeter of said floor adjacent said upstanding wall and secured to said floor along their respective bases, said open conduit of said first and second members facing said wall for channeling fluid collected therein, at least one connecting member receivable within said open conduit of said first and second members for joining said members in end-to-end relationship, and a stop member arranged adjacent the ends of said first and second members and projecting from the plane of the sides of said first and second members for abutting against the ends of said connecting member when said connecting member is received within said open conduit of said first and second members to limit the extent of longitudinal engagement therewith.

31. The gutter of claim 30, wherein said second member has a plurality of transverse score lines longitudinally dividing its side and a plurality of transverse slots longitudinally dividing its base, said slots being in registration with said score lines whereby predetermined lengths of said second member between said score lines can be separated from the remainder of said second member.

32. The gutter of claim 31, further including a lip downwardly extending along an edge of said side of said second member, said lip having a plurality of transverse slots in registration with said score lines for longitudinally dividing said lip to facilitate separating said predetermined portions of said second member from the remainder thereof.

33. The gutter of claim 30, wherein said sides of said first member and said second member each include a downwardly extending lip along an edge thereof, and said connecting member arranged underlying a portion of said lip of said first and second members.

34. The gutter of claim 30, wherein said connecting member and those portions of said second member between said score lines each include locking means for locking said connecting member to said second member when said connecting member is received within said open conduit of said second member.

35. The gutter of claim 34, wherein a portion at the ends of said first member include said locking means for locking said connecting member to said first member when said connecting member is received within said open conduit of said first member, whereby said first and second members are connected together in longitudinal alignment with one another by said connecting member.

36. The gutter of claim 35, wherein said locking means comprise projections on said first and second members and depressions on said connecting member, said depressions releasably receiving said projections therein.

* * * * *

UNITED STATES PATENT AND TRADEMARK OFFICE

CERTIFICATE OF CORRECTION

PATENT NO. : 4,660,333

DATED : April 28, 1987

INVENTOR(S) : T. Romer

It is certified that error appears in the above-identified patent and that said Letters Patent is hereby corrected as shown below:

Column 8, line 59, after "members" insert --are--.

Column 9, line 56, change "call" to --wall--.

Signed and Sealed this

Fifteenth Day of December, 1987

*Attest:*

DONALD J. QUIGG

*Attesting Officer*

*Commissioner of Patents and Trademarks*